US008167086B1

(12) United States Patent
Brendley et al.

(10) Patent No.: US 8,167,086 B1
(45) Date of Patent: May 1, 2012

(54) FAST ROPE DESCENT SYSTEM

(76) Inventors: Kurt A. Brendley, McLean, VA (US); Omar B. Bohsali, McLean, VA (US)

( * ) Notice: Subject to any disclaimer, the term of this patent is extended or adjusted under 35 U.S.C. 154(b) by 523 days.

(21) Appl. No.: 11/080,671

(22) Filed: Mar. 16, 2005

Related U.S. Application Data

(60) Provisional application No. 60/553,503, filed on Mar. 16, 2004.

(51) Int. Cl.
*A62B 1/14* (2006.01)

(52) U.S. Cl. ..... 182/5; 182/192

(58) Field of Classification Search ..... 182/5, 191–193; 188/65.2, 65.4
See application file for complete search history.

(56) References Cited

U.S. PATENT DOCUMENTS

| | | | | | |
|---|---|---|---|---|---|
| 111,928 | A * | 2/1871 | Kenyon | 267/36.1 |
| 181,577 | A * | 8/1876 | Holthausen | 188/65.4 |
| 287,856 | A * | 11/1883 | Parsels | 182/193 |
| 291,940 | A * | 1/1884 | Robertson | 182/191 |
| 292,981 | A * | 2/1884 | Brooke | 182/5 |
| 386,237 | A * | 7/1888 | Budd | 188/65.4 |
| 1,181,767 | A * | 5/1916 | Houdyshell | 24/131 R |
| 3,217,840 | A * | 11/1965 | Holkesvick | 188/65.4 |
| 5,352,172 | A * | 10/1994 | Suzaki | 482/120 |
| 5,511,291 | A * | 4/1996 | Crawford | 24/129 R |
| D376,095 | S * | 12/1996 | Curtis | D8/356 |
| 6,511,320 | B2 * | 1/2003 | Esposito | 433/141 |
| 7,249,395 | B2 * | 7/2007 | Brammer et al. | 16/412 |

* cited by examiner

*Primary Examiner* — Alvin Chin Shue
(74) *Attorney, Agent, or Firm* — Hunton & Williams LLP

(57) ABSTRACT

A system for descending a rope regardless of the tension on the working end of the rope. The system comprises a frame having first, second, third and fourth sides, the first and third sides being relatively positioned at a first angle and the second and fourth sides being relatively positioned at a second angle. In some embodiments, the sum of the first angle and the second angle equals 180 degrees. The system also includes a plurality of friction nodes associated with the first side for: (1) receiving a rope, (2) enabling the frame to selectively move up or down relative to the rope, and (3) applying a select amount of friction to the rope according to the relative position of the frame to the rope.

15 Claims, 10 Drawing Sheets

FAST ROPE DESCENT SYSTEM

RELATED APPLICATIONS

This patent application claims the benefit of a U.S. provisional patent application titled "Fast Rope Descent System," filed Mar. 16, 2004 and assigned Ser. No. 60/553,503. The specification and drawings of the provisional are specifically and entirely incorporated herein by reference.

FIELD OF THE INVENTION

The present invention is directed to systems and methods for descending a rope, and more particularly to a system and method for descending a rope at selective speeds regardless of the tension on the working end of the rope.

BACKGROUND OF THE INVENTION

Numerous activities exist that require humans to safely and rapidly descend from high elevations. Mountain climbing, for example, is one such activity. While climbing up a mountain may be time-consuming and laborious, the descent should be as quick, smooth and safe as possible. Other examples are fire and rescue operations where personnel may have to descend to or from a particular location as quickly as possible without risking harm to an individual or himself. For example, coast guard rescue crews typically descend from a hovering helicopter in order to board a distressed vessel, while firemen may have to quickly lower victims from a burning structure. In both cases, time is of the essence and the need for quick and safe descent is paramount.

Many rope descent systems and techniques have been developed over the years to tackle these and other scenarios. For example, military personnel worldwide use a technique called a "fast rope" that permits military units to quickly descend from a hovering aircraft. Current fast rope techniques were first developed by the British military but have since found widespread use throughout the world. The great attraction of the fast rope technique is that it permits an individual or several individuals to simultaneously, quickly, stealthily and accurately descend from a high elevation. While there are many variations, the basic fast rope technique consists of two pieces of equipment: a rope of sufficient diameter to permit the user to firmly grip it with his hands and a pair of leather or heavy-duty gloves, such as Nomex™ gloves, for example. The user simply grips the rope and either slides down the rope in a similar manner to a fireman sliding down a pole or angles his feet into the rope using his body to create a torque between hands and feet.

While fast rope techniques have the advantages of multiple users on the rope, fast descent speed, accuracy and simplicity, they do so by sacrificing safety and load-carrying capabilities. Since equipment must often be dropped separately, procedures for equipment drop-off and pick-up can be time-consuming and inefficient. Safety issues with fast rope techniques also loom large. Of all current rope descent mechanisms and techniques, only the fast rope technique lacks belay or self belay capabilities, e.g. where a belayer or the user himself may suddenly stop or slow his descent. In fact, since the user is merely holding onto the rope with his hands, freefall accidents are common, as are burns, concussions, broken limbs and so forth.

Other traditional rope descent systems and techniques have been developed such as belayer, rappel rack, brake tube and FIG. 8 devices, for example, but they take more time to set up, permit only one person on the rope at a one time and require the user to wear a specialty harness.

These and other problems exist.

SUMMARY OF THE INVENTION

An object of the present invention is to overcome the aforementioned and other drawbacks existing in prior art systems and methods.

One object of the invention is to provide a rope descent system that permits or enables safe descent by a subject.

Another object of the invention is to provide a rope descent system that permits or enables users to descend while carrying loads.

Another object of the invention is to provide a rope descent system that permits or enables users to quickly and safely descend.

Yet another object of the invention is to provide a rope descent system that is easy to set up and use.

Yet another object of the invention is to provide a rope descent system that enables a user to easily mount on or off.

Yet another object of the invention is to provide a rope descent system that permits a user to descend down long ropes when needed.

Another object of the invention is to provide a rope descent system that permits the user to efficiently stop so as to prevent the user from overrunning the rope end.

Yet another object of the invention is to provide a rope descent system that is suitable for one or more subjects to descend the rope at same time.

Yet another object of the invention is to provide a rope descent system that is rugged in design and material.

Another object of the invention is to provide a rope descent system that is manufactured at a low cost and has a long lifetime.

Yet another object of the invention is to provide a rope descent system that permits equipment to descend down the rope.

Yet another object of the invention is to provide a rope descent system that allows safe descent even when the user is injured or unconscious.

Yet another object of the invention is to enable a variety of ropes and cables to be used for descent in addition to the traditional, very thick and expensive fast rope and specialty climbing ropes such as static line.

According to various embodiments of the present invention, systems and methods are provided that enable a user to descend down a rope at user-selected speeds, regardless of the tension of the working end of the rope. In some embodiments, the systems of the invention enable a user to selectively adjust the amount of friction being asserted against a rope during descent to slow down the rate of descent or bring the user to a complete stop. The user may also decrease the amount friction to resume or increase the speed of descent.

According to one embodiment of the invention, a system for descending a rope is provided. The system comprises a frame having first, second, third and fourth sides, the first and third sides being relatively positioned at a first angle and the second and fourth sides being relatively positioned at a second angle; and a plurality of friction nodes associated with the first side for: (1) receiving a rope, (2) enabling the frame to selectively move up or down relative to the rope, and (3) applying a select amount of friction to the rope according to the relative position of the frame and the rope.

In another embodiment of the invention, a system for descending a rope is provided. The system comprises a frame having first, second, third and fourth sides, the first side having a handle portion associated therewith, the second side having a plurality of friction nodes for receiving the rope and for applying a select amount of friction to the rope, and the third side having a notch for receiving a rope; and an adjustable arm connected to a distal end of the second side, the adjustable arm being able to pivot about the distal end of the second side and having a plurality of friction nodes that cooperate with the friction nodes on the second side to apply a variable amount of friction to the rope.

In yet another embodiment of the invention, a system for descending a rope is provided. The system comprises frame means for enabling a user to descend down a rope at speeds or rates determined by the user; and friction means associated with the frame means for selectively applying an amount of friction to the rope regardless of the tension of a working end of the rope.

The accompanying drawings, which are incorporated in and constitute a part of this specification, illustrate various embodiments of the invention and, together with the description, serve to explain the principles of the invention.

DETAILED DESCRIPTION OF THE INVENTION

Figure 1:
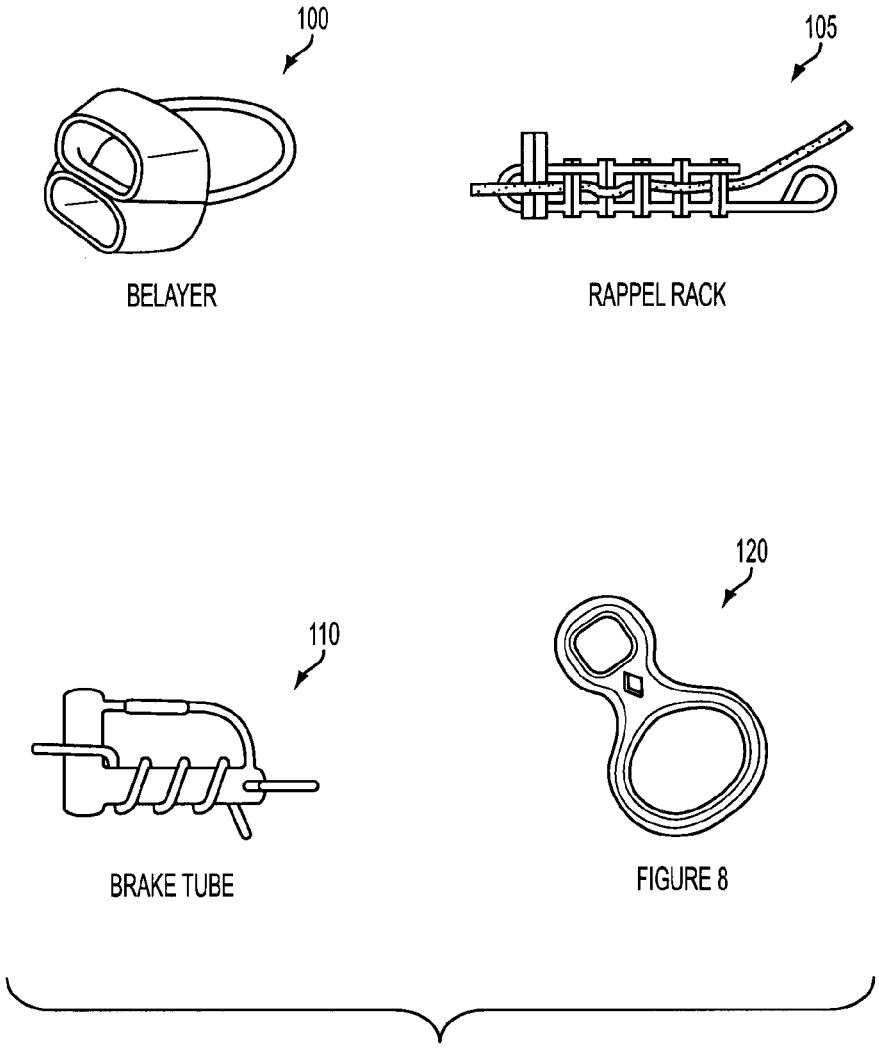
FIG. 1 (PRIOR ART)
FIG. 1 is a diagram of four prior art systems or devices for descending a rope.

Reference will now be made to illustrative embodiments of the invention(s) described herein, examples of which are illustrated in the accompanying drawings in which like reference characters refer to corresponding elements.

The present invention(s) are described in relation to various systems and methods for enabling users to descend a rope at varying speeds and rates. Nonetheless, the characteristics and parameters pertaining to the various embodiments of the systems and methods described herein may be applicable to systems and methods for descending other objects, such as poles, posts, cables, etc.

FIG. 1 illustrates four prior art systems for descending down a rope: belayer 100, rappel rack 105, brake tube 110, and figure 8 120. With all of these devices, the speed of rope travel through the device is a function of the force applied to the device and the amount of force applied to the working end of the rope. The working end of the rope is that end to which force is applied to control the rate of descent, typically the portion of the rope below the device. For example, as a rappeller descends, he controls the rate of descent by how much tension he applies to the working end, normally by gripping it with a gloved hand. Belayer 100, brake tube 110, and figure 8 120 operate the same way. Just a few pounds of change in force to the working end of the rope can result in dramatic changes in rate of descent. In addition, a user can alter the rate of descent by changing the geometry of rope configuration. For example, the user of belay 100 can rapidly "lock" the rope across the device to stop a descent or even a fall by properly adjusting the tension of the rope. The other devices work in the same or similar way.

However, none of the above systems enable a user to control the rate of descent when multiple individuals are descending the rope at the same time, such as in sequential or serial fashion, for example. Primarily, this is because the multiple users on the rope create tension on the working end of the rope, making it extremely difficult if not impossible for a user to selectively adjust the tension of the rope to regulate and/or control the speed of descent. While the user closest to the ground would have little weight below him on the working end of the rope, those users above him would have at least one or possibly several people below them that significantly limit their ability to control working end rope tension. Given how the above devices are used to regulate the speed of descent down a rope, it is clear that they are not suited for operations where the working end of the rope cannot be controlled.

Figure 2:
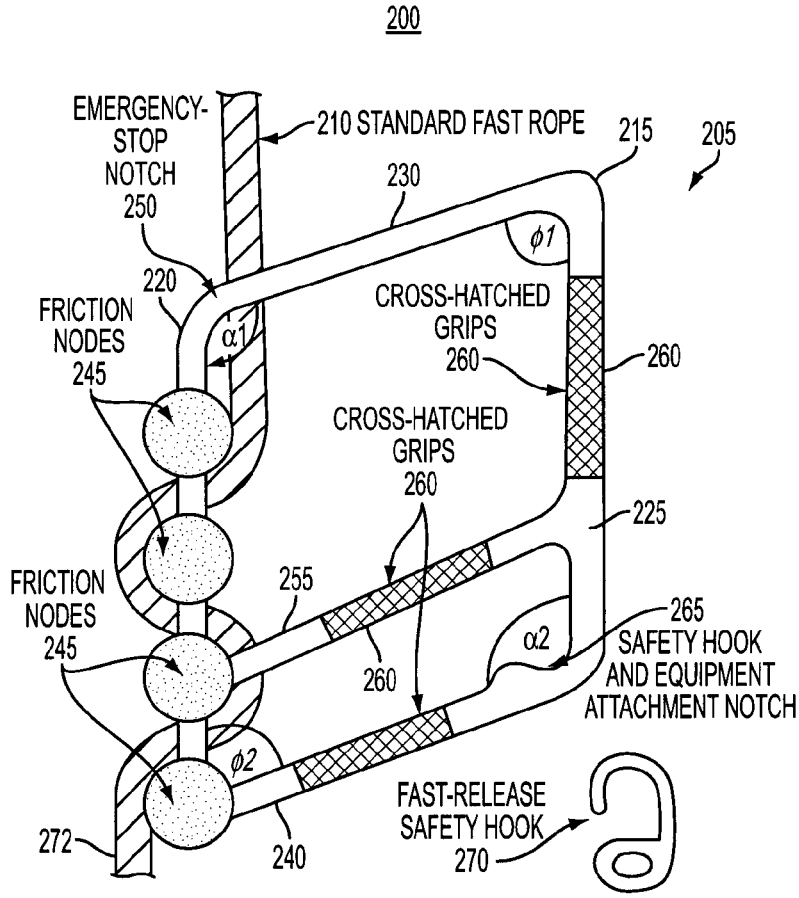
FIG. 2 is a side view of a system 200 for descending a rope, according to one embodiment of the invention.

FIG. 2 illustrates a system 200 for descending a rope 210 regardless of the tension on the working end of the rope, according to one embodiment of the invention. As shown, system 200 may comprise a frame 205 having a first side 220, a second side 225, a third side 230, and a fourth side 240. In some embodiments the first side is connected to or formed into the third side at an angle $\alpha_1$, the second side is connected to or formed into the third side at an angle $\Phi_1$. In some embodiments, the first side is connected to or formed into the fourth side at an angle $\Phi_2$, while the second side is connected to or formed into the fourth side at an angle $\alpha_2$. In some embodiments, $\alpha_1$ and $\alpha_2$ are each greater than ninety (90 degrees), while $\Phi_1$ and $\Phi_2$ are each smaller than 90 degrees. In some embodiments, $\alpha_1=\alpha_2$ and $\Phi_1=\Phi_2$. In some embodiments, $\alpha_1+\Phi_1=180$ degrees, and $\alpha_2+\Phi_2=180$ degrees. Preferably, $\alpha_1$, $\alpha_2$, $\Phi_1$ and $\Phi_2$ are selected so that a user of system 200 is better able to control and/or regulate his descent down a rope in the manner described herein. Preferably, frame 205 is made of a durable light-weight plastic, metal, or alloy material. Other materials are of course possible.

As shown, rope 210 may pass through an emergency stop notch 250 (see FIG. 2*a*) and a series of friction nodes 245. Rope 210 may be selected for its strength and frictional coefficient when interacting with friction nodes 245. Rope 210 may be made of hemp, Kevlar, steel or other alloy. Other materials are of course possible. In some embodiments, rope 210 may also pass through friction nodes 245 associated with, connected to, or formed onto the first side 220. In some embodiments, the geometry of some or all of the friction nodes is/are carefully selected to give the required range of weights on the working side of the rope. In some embodiments, for example, friction nodes 245 may comprise cylindrical elements having a surface that asserts a desired friction against a rope during descent. Various embodiments of friction nodes 245 are shown in FIGS. 5, 5*a*, 5*b* and 5*c*. In some embodiments, rope 210 may be interlaced or looped through a plurality of friction nodes in alternating fashion, such that, for example, some of the nodes comprise external nodes and others comprise internal nodes. While FIG. 2 shows four friction nodes 245, any number of nodes may be used. Preferably, friction nodes 245 are made of a durable light-weight plastic metal, or alloy material. Other materials are of course possible.

In some embodiments, friction nodes 245 may be stationary (e.g., they have no moving parts). In various embodiments, however, select friction node(s) 245 may be activated and/or loaded with springs, bearings, or other techniques or elements to affect or influence the frictional force asserted by the node(s), individually or in the aggregate. While friction nodes 245 are shown arranged in a linear fashion, in some embodiments they may be positioned according to a predetermined layout to achieve a desired friction amount (e.g., see FIG. 3). In some embodiments, friction nodes 245 may be directly connected to or formed into frame 205, or indirectly through connectors 248, as shown.

In some embodiments, system 200 may also include a handle portion 255 that may provide an additional grip 260 for enabling a user to hold on during descent and/or control the position of the frame 205 in relation to the rope. Handle 255 may be connected to or formed into the first and/or second sides. Second and fourth sides 225 and 240, or any part portion of frame 205, may also include grips 260. Thus, a user may hold onto any two grip portions 260, for example, to leverage force/torque against the frame and affect its position in relation to the rope. In some embodiments, a user may hold onto grips 260 at a sufficient distance from the rope to permit sufficient leverage to be applied to turn the frame 205 as desired. The further from the rope, the greater the force/torque asserted against the rope and the greater the ability to "turn" the device and slow down or stop descent. In some embodiments, the higher that the first side 210 and/or second side 225 extends above the emergency stop notch 250, the easier it may be for a user to apply a desired amount of force/torque to position the frame 205 in relation to the rope and thus decelerate the device. As will be explained below, altering or turning the position of frame 205 in relation to the rope allows a user to regulate or control the speed of descent down the rope, regardless of the tension at the working end of the rope 272.

In some embodiments, frame 205 may also include a safety hook notch that may be used to attach a safety hook notch 265 that connects to a safety hook 270 connected to the user so that in the event the user loses his grip on frame 205, the safety hook 270 may hold on to the user and prevent injury. In some embodiments, the safety hook notch 265 may be positioned on the frame 205 such that were a user to lose his grip, the force of the user's weight would apply sufficient torque to descend the user at a constant and safe rate. In some embodiments, the user could also hook the safety hook 270 or other safety device onto the frame 205 at any location. In some embodiments, safety hook notch 265 may also be used to attach equipment, thus enabling a user to carry heavy or otherwise cumbersome equipment during descent or to lower equipment separately from the user's own descent.

Figure 2A:
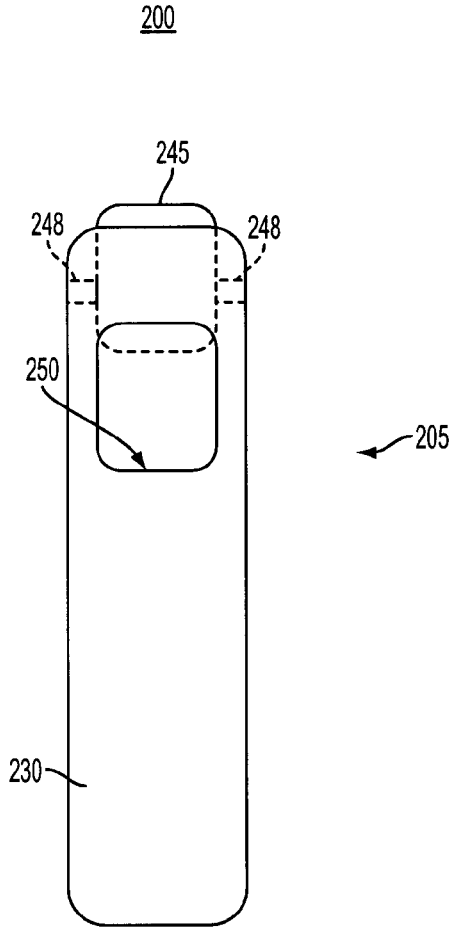
FIG. 2*a* is a top view of system 200 for descending a rope, according to one embodiment of the invention.
Figure 2B:
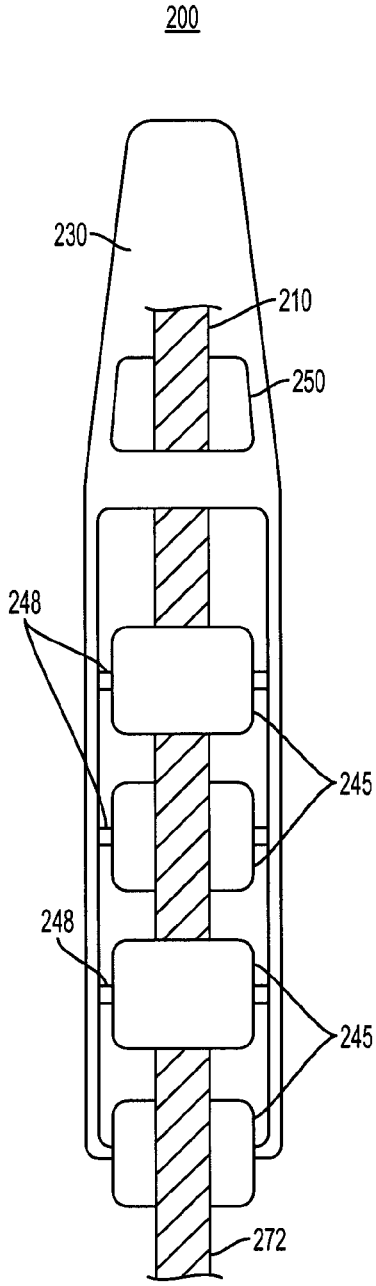
FIG. 2*b* is a front view of the system 200 for descending a rope, according to one embodiment of the invention.

FIG. 2*a* illustrates a top view of the system 200 for descending a rope, according to one embodiment of the invention. As shown, system 200 includes an emergency stop notch 250 formed through third side 230 through which a rope (not shown) is threaded prior to being interlaced or looped through a plurality of friction nodes 245. In some embodiments, emergency stop notch 250 may assert friction against the rope to enable a user to selectively come to a complete stop or reduce his speed of descent. In some embodiments, the emergency stop notch may comprise an opening that narrows to a diameter less than that of the rope as one turns the frame 205 in relation to the rope. Such a small diameter position would effectively cause the emergency stop notch 250 to pinch the rope, resulting in a complete stop or reduction in the speed of descent. FIG. 2*b* illustrates a front view of the system 200 for descending a rope, according to one embodiment of the invention. As shown, rope 210 is inserted through emergency stop notch 250, interlaced or looped through friction nodes 245 in an alternating manner. As previously stated, a user may use system 200 to descend down a rope at selectively varying speeds regardless of the tension at the working end of the rope 272 with or without the emergency stop notch engaged.

Figure 3:
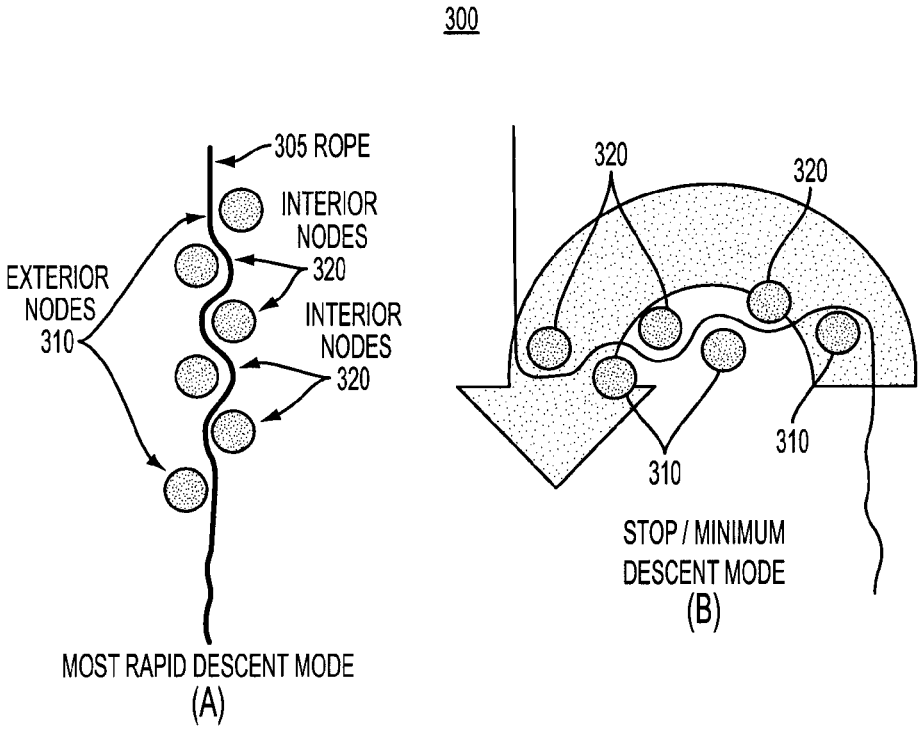
FIG. 3 is an illustration of a system 300 for descending a rope, according to one embodiment of the invention.

FIG. 3 illustrates the operation of system 200 between a first position (A) where the most rapid descent may be achieved and a second position (B) where a complete stop or a minimum descent is achieved. In the former, the series of nodes is in line with the direction of travel of the rope 305 (normally vertical, but also in any angled direction), thus they impose minimal friction on the rope, permitting the device to slide easily down the rope. However, when the device is turned such that the series of nodes is cantered at an angle from the vertical, there is significantly greater contact area of the end nodes with the rope. This greatly increases the frictional force on the rope, causing the device to slow or stop.

As previously stated, system 200, unlike the prior art, permits a user to selectively alter the rate of descent and/or come to a complete stop, regardless of working end rope tension (e.g., regardless of whether or not multiple individuals are descending down the rope at the same time). That is, system 200 is effective even with very large changes in tension on the working side of the rope. System 200 works by controlling the geometry of the rope through the device. That is, the frictional force applied to a rope is a function of the coefficient of friction between the rope and the surface it rides over and the sum of the angles over which the rope is bent.

Figure 3A:
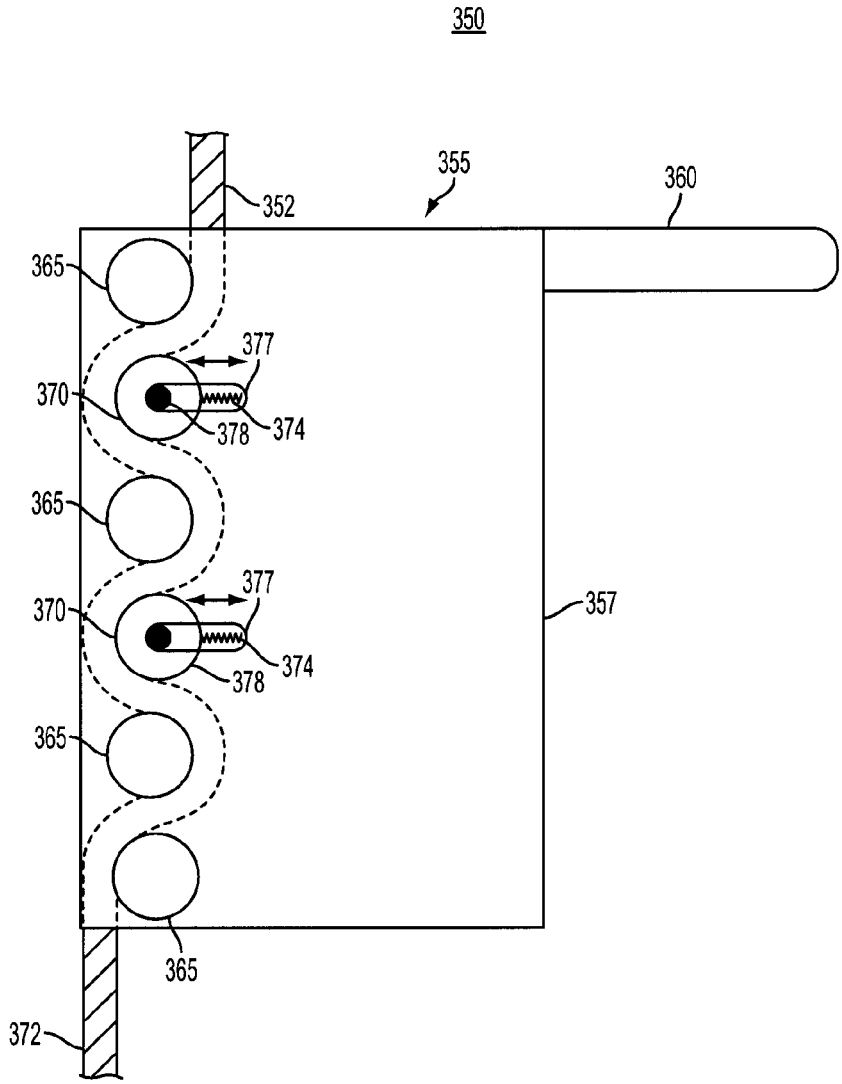
FIG. 3*a* is a side view of a system 350 for descending a rope, according one embodiment of the invention.

FIG. 3*a* illustrates a side view of a system 350 for descending a rope, according to an embodiment of the invention. As shown, system 350 comprises a frame 355 consisting of side wall 357 and handle 360. Rope 352 may be received by a series of external friction nodes 365 and spring-loaded internal friction nodes 370. In some embodiments, external friction nodes 365 are rigidly attached to frame 355. Spring-loaded friction nodes 370 may be connected to a spring element 377 to enable lateral movement as shown by the bi-directional arrow. In some embodiments, spring-loaded friction nodes may have protrusions 378 that freely move within slots 377 (cut out of walls 357 and 357*a*) to enable lateral movement of node 370 as shown. In some embodiments, spring element 374 may urge spring-loaded friction nodes 370 toward a collinear position with friction nodes 365. However, increased tension on the working end of the rope 372 (e.g., person or weight below the user on a rope) may operate to compress spring 300 (e.g., counteract the force of spring 374) and urge spring-loaded friction nodes 370 away from a collinear relation with nodes 365, as shown by the arrows in FIG. 3*a*. Therefore, as the tension is increased on the working end of the rope 372, the friction asserted against the rope is reduced (e.g., by reducing the total surface area of friction nodes coming into contact with the rope), resulting in an increase in the rate of descent. However, the closer the nodes 370 are to a collinear relationship with nodes 365 (e.g., the lesser the tension on the working end of the rope 372), the greater the friction asserted against the rope (e.g., as a result of greater surface contact between the friction nodes and the rope) and the slower the speed or rate of descent. In some embodiments, a user of system 350 may influence the positioning of spring-loaded friction nodes 365, and thus the speed of descent, by increasing/reducing force to handle 360. In some embodiments, such increase/decrease in force may be accomplished by the user shifting his weight (e.g., leaning into or away from the device).

Figure 3B:
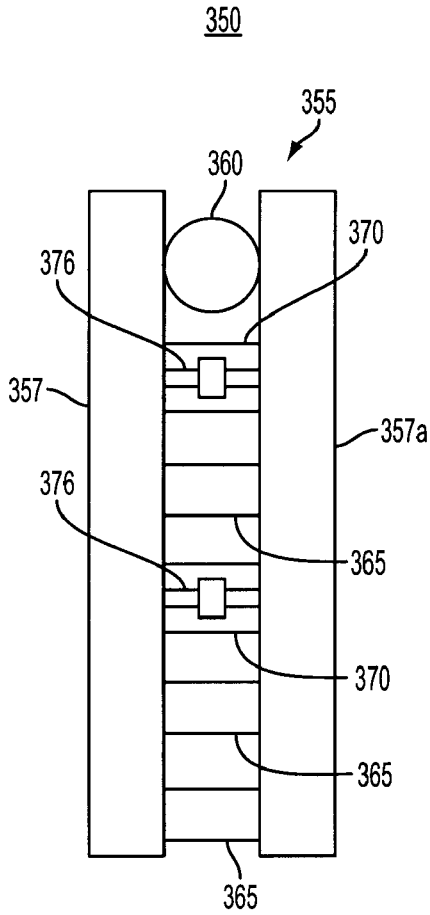
FIG. 3*b* is a front view of the system 350 for descending a rope, according to an embodiment of the invention.

FIG. 3*b* illustrates a front view of system 350 showing walls 357 and 358, handle 360, external nodes 365, friction nodes 370, stationary wall or bracket 376 (attached to spring 374 (not shown)).

Figure 3C:
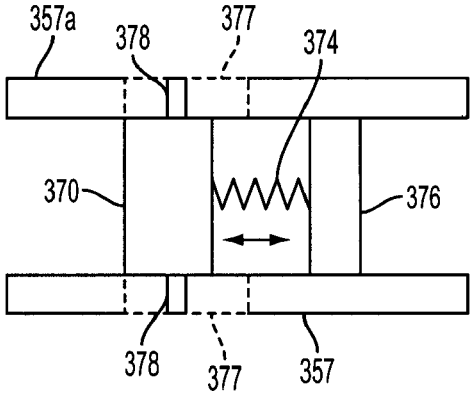
FIG. 3*c* is a cross-sectional view of the structure of a spring-loaded friction node of system 350, according to an embodiment of the invention.

FIG. 3*c* illustrates a top view of a spring-load friction node portion of system 350, according to one embodiment of the invention. As shown, the spring-load portion may comprise walls 357 and 357*a*, spring-loaded friction node 370, spring element 374, stationary wall or bracket 376, slots 377 (cut out of walls 357 and 357*a*), and protrusions 378. In some embodiments, slots 377 accommodate protrusions 378 enabling node 370 to laterally move as shown by the arrow.

Figure 3D:
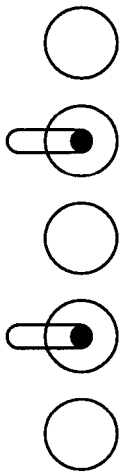
FIGS. 3*d*-3*i* illustrate various configurations of friction nodes for use with the systems described, according to various embodiments of the invention.
Figure 3E:
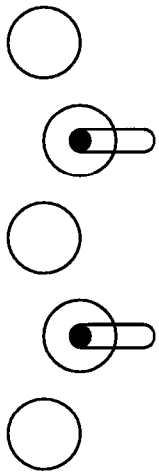
Figure 3F:
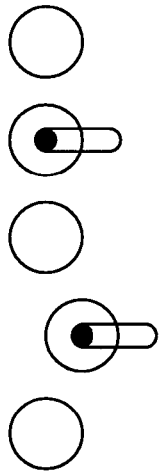
Figure 3G:
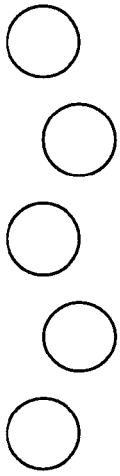
Figure 3H:
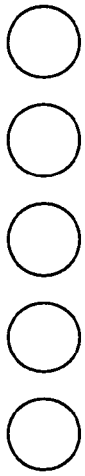
Figure 3I:
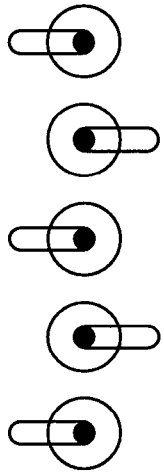

FIGS. 3*d*-3*h* illustrate various embodiments of spring-loaded friction node portions that may be used with any of the rope descending systems described herein. FIG. 3*d* illustrates three stationary nodes and two spring-loaded nodes, where the spring-loaded nodes move towards the left to accommodate increase in rope tension. FIG. 3*e* illustrates three stationary nodes and two spring-loaded nodes, where the spring-loaded nodes are not in a collinear relationship with the stationary nodes when rope tension is at a minimum. FIG. 3*f* illustrates three stationary nodes and two spring-loaded nodes, where one of the spring-loaded nodes is collinear with the stationary nodes when rope tension is at a minimum while the other friction node is not collinear. FIG. 3*g* illustrates five station nodes, where three comprise external stationary nodes and two comprise internal stationary nodes. The distance between the line defined by the three external nodes and the line defined by the two internal nodes is determined according to the desired friction needs. In some embodiments, the three friction nodes may comprise internal nodes, while the two friction nodes comprise external nodes. FIG. 3*h* illustrates five stationary nodes forming a single line. FIG. 3*i* illustrates five spring-loaded friction nodes forming a single line. In this embodiment, the spring(s) are placed such that they do not interfere with movement of the rope. For example, the spring may be placed slightly to the side of the rope, or, in another embodiment, two springs may be used with the rope being positioned in between the two springs. Other techniques are possible. Also, this embodiment may also have some nodes that are not collinear with other nodes when tension of the rope is at a minimum. Although each example is shown with five nodes, any number of nodes (stationary or spring-loaded) is possible. Other embodiments, configurations, or variations of the systems in FIGS. 3*d*-3*i* are possible.

Figure 4:
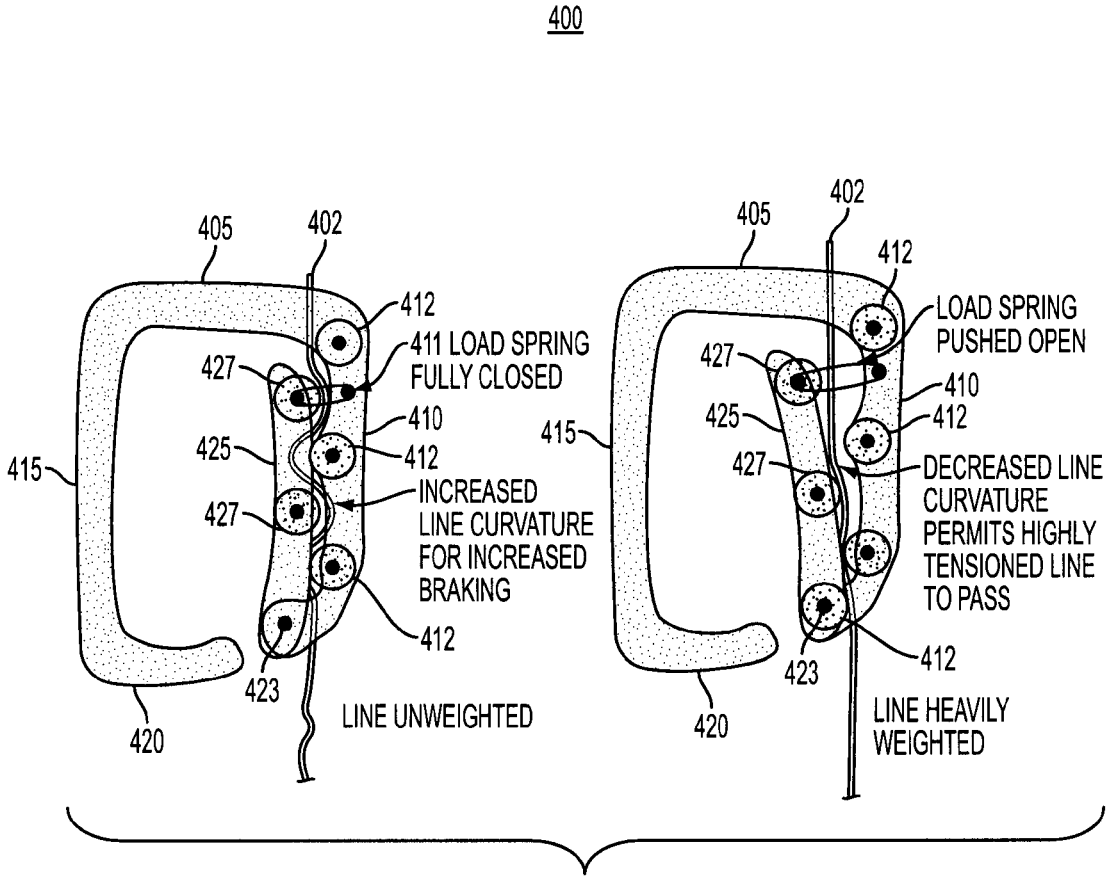
FIG. 4 is a side view of a system 400 for descending a rope, according to one embodiment of the invention.

FIG. 4 illustrates a system 400 for descending a rope, according to one embodiment of the invention. While approaches using no moving parts (e.g., system 200) have advantages, attaining frictional coefficients that are sufficiently high may sometimes be problematic. Another embodiment of a fast rope descent system may include spring-loading or otherwise actuating the interior and/or interior and exterior nodes. The basic concept here is that as the tension on the working side of the rope increases, it forces the spring-loaded nodes to separate, thereby reducing the amount of surface coming into contact with the rope. In general, it is more beneficial to alter the interior nodes in this manner since spring-loading the exterior nodes would simply change their relative geometry, causing the device to either tilt more or less.

As shown in FIG. 4, a rope 402 passes through a line of friction nodes 412 associated with arm 410 and interior friction nodes 427 associated with adjustable arm 425 which is connected to and pivots about arm 410 at point 423. Arms 415 and 420 may respectively operate to give the user leverage during descent and to hang objects and/or attach/harness the user to the device. Although not shown, side 405 may also include an emergency stop notch as described above in connection with system 200.

While only one interior node 427 is shown as being spring-loaded with spring 411, the concept would be equally valid for any number of spring-loaded interior nodes and/or exterior. For example, one may choose to spring-load one or two of the four, or one may have more or fewer interior and/or exterior nodes. Many specific design options are possible, but they all use the same overriding concept of dynamically changing the node geometry as a function of rope tension.

While the above example uses a linear spring, other types are possible. There are many ways of applying a restoring force that opposes the tension of the rope as do the linear springs. Examples include but are not limited to:

(1) Coil spring with cams—The friction nodes could be shaped as a cam and actuated by a coiled spring. The spring would continually attempt to push the cam into the rope. Advantages of this design are that it would be compact and relatively easy to construct. The primary disadvantage is that the cam could "spin" in such a way as to unwind the coil. Of course, this could be controlled or managed by use of a mechanical stop or other device.

(2) Flexible friction nodes—Since the nodes only need to move a small distance to affect large angular changes, the interior nodes 427 could be a flexible material such as a hard rubber or polymer. These would act as springs and achieve the desired control effect. Important design elements would include choice of material and geometry yielding the proper range of motion.

(3) Damped rollers—In some embodiments, systems 200 and 300 used friction nodes where the friction between node and rope provided the controlling force. In some embodiments, however, damped rollers may be used, particularly for the interior nodes. Such a roller could normally act as a friction node until there is great tension on the rope, normally caused by a heavy load beneath the user. This tension would overcome the nodes natural tendency to not roll, and it would cause them to roll but as restricted with either a damping force or torsional friction.

The above friction node embodiments may also be used in connection with system 200 or 350 described above.

Figure 5:
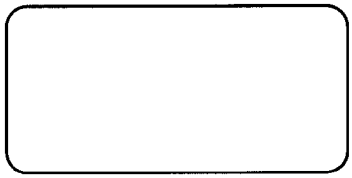
FIG. 5 illustrates one embodiment of a friction node, according to one embodiment of the invention.
Figure 5A:
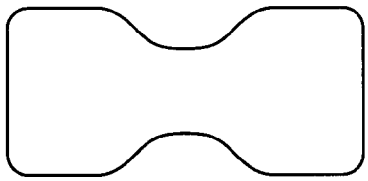
FIG. 5*a* illustrates one embodiment of a friction node, according to one embodiment of the invention.
Figure 5B:
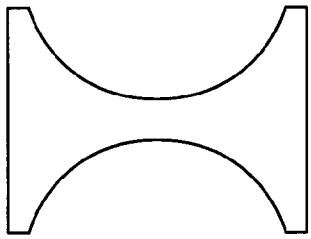
FIG. 5*b* illustrates one embodiment of a friction node, according to one embodiment of the invention.
Figure 5C:
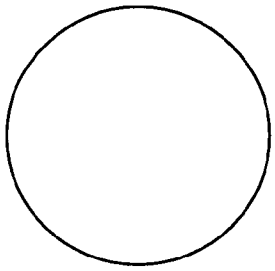
FIG. 5*c* illustrates one embodiment of a friction node, according to one embodiment of the invention.

FIGS. 5, 5*a*, 5*b*, and 5*c* illustrate various embodiments of friction nodes for use with the various systems and methods described herein. FIG. 5, for example, illustrates a cylindrical element having a certain surface capable of asserting friction to a passing rope. FIG. 5*a* is similar, but includes a channel for guiding passage of the rope and for increasing the amount of friction asserted against the rope. FIG. 5*b* illustrates a larger channel for use with larger ropes. FIG. 5*c* illustrates an exemplary side view of any of the friction nodes of FIG. 5, 5*a*, or 5*b*.

The various embodiments of the systems and methods described and claimed herein provide numerous advantages. For example, the systems and methods permit a user to descend a rope at various speeds and rates as determined by the user, regardless of the tension on the working end of the rope, for example. Other advantages include but are not limited to: single piece construction is possible; lack of moving parts in some embodiments; spring-actuated design possible in some embodiments; provides larger range of control than currently available systems and techniques; increased safety over current systems and techniques; permits fast and safe descents; user controls and regulates descent via weight shift: e.g., lean forward, very rapid descent—lean back, slow down or stop; automatic emergency belay with safety notch and hook; user may hook onto on prescribed rung (e.g., safety notch and hook); able to achieve a complete or slow, steady descent in "no hands" mode (e.g., user loses grip on device); removes requirement for cumbersome, thick gloves; user can descend carrying full load or can attach equipment directly onto device for a controlled equipment-only descend; supports both multiple users on same rope and single user; permits use of smaller diameter ropes or compatible with existing fast rope system; fast to set up; fast to get on/off rope; easy to use; permits much longer rope when needed; permits stop at rope end to prevent user overrunning rope end; rugged design; low manufacturing costs; and long lifetime. In addition, the systems and methods described herein enable a user to rapidly and safely descend from a high elevation without suffering any of the drawbacks of current systems and methods.

Other embodiments, uses and advantages of the present invention will be apparent to those skilled in the art from consideration of the specification and practice of the invention disclosed herein. The specification and examples should be considered exemplary only.

The invention claimed is:

1. A system for descending a rope, comprising:

a frame having first, second, third and fourth sides;

the first and third sides being relatively positioned at a first angle that is an obtuse angle and the first angle is located interior to the frame at a junction of the first and third sides, and the second and fourth sides being relatively positioned at a second angle that is an obtuse angle and the second angle is located interior to the frame at a junction of the second and fourth sides;

the second and third sides being relatively positioned at a third angle that is an acute angle and the third angle is located interior to the frame at a junction of the second and third sides, and the first and fourth sides being relatively positioned at a fourth angle this is an acute angle and the fourth angle is located interior to the frame at a junction of the first and fourth sides;

a plurality of friction nodes associated with the first side for: (1) receiving a rope, (2) enabling the frame to selectively move up or down relative to the rope, and (3) applying a select amount of friction to the rope according to the relative position of the frame and the rope;

a safety hook notch located proximal to the fourth side and being integral to the frame;

at least two grip elements located on the second and fourth sides of the frame; and an emergency stop notch located proximal to the third side, the emergency stop notch operating to immediately stop descent, and comprising an opening in the frame.

2. The system of claim 1 wherein the frame is selectively moveable between a first position wherein the frame is able to move relative to the rope with a minimal amount of friction and a second position wherein the frame is not able to move relative to the rope.

3. The system of claim 2 wherein in the first position the first side is substantially collinear with the direction of descent, and in the second position the first side is substantially perpendicular to the direction of descent.

4. The system of claim 1 wherein each friction node is attached to the first side of the frame.

5. The system of claim 1 wherein each friction node comprises a cylindrical member.

6. The system of claim 1 wherein the rope is interlaced, threaded, or looped though the plurality of nodes.

7. The system of claim 1 further comprising a grip element connected to the first and second sides of the frame, the grip element being substantially parallel to the third and fourth sides of the frame.

8. The system of claim 2 wherein in the first position the a portion of the frame means is substantially collinear with the direction of descent, and in the second position the portion of the frame means is substantially perpendicular to the direction of descent.

9. The system of claim 1 wherein the first and second sides are substantially parallel and the third and fourth sides are substantially parallel.

10. The system of claim 1, wherein the first angle and the second angle are equal.

11. The system of claim 1, wherein a sum of the first angle and the fourth angle is 180 degrees.

12. A system for descending a rope, comprising:

a frame, for enabling a user to descend down a rope at a speed or rate determined by the user, having first, second, third and fourth sides;

the first and third sides being relatively positioned at a first angle that is an obtuse angle and the first angle is located interior to the frame at a junction of the first and third sides, and the second and fourth sides being relatively positioned at a second angle that is an obtuse angle and the second angle is located interior to the frame at a junction of the second and fourth sides, the first and second sides being substantially parallel;

the second and third sides being relatively positioned at a third angle that is an acute angle and the third angle is located interior to the frame at a junction of the second and third sides, and the first and fourth sides being relatively positioned at a fourth angle this is an acute angle and the fourth angle is located interior to the frame at a junction of the first and fourth sides;

friction means, associated with the frame, for selectively applying an amount of friction to the rope regardless of the tension of a working end of the rope;

at least two grip means, with one grip means located on the second side and one grip means located on the fourth side of the frame for enabling the user to grab onto the frame means; and an emergency stop notch located proximal to the third side, the emergency stop notch operating to immediately stop descent, and comprising an opening in the frame.

13. The system of claim 12 further comprising a safety notch associated with the frame for harnessing a user to the frame.

14. The system of claim 12 wherein the user adjusts the speed or rate of descent by adjusting his body weight.

15. The system of claim 12 wherein the frame is selectively moveable between a first position wherein the frame is able to move relative to the rope with a minimal amount of friction and a second position wherein the frame is not able to move relative to the rope.

* * * * *